US005752722A

United States Patent [19]

Moore et al.

[11] Patent Number: 5,752,722

[45] Date of Patent: May 19, 1998

[54] MULTIPART FORM AND LABEL COMBINATION

[75] Inventors: Michael J. Moore, Loveland; Patrick A. Konkol, Cincinnati; Lawrence W. Arway, Kettering, all of Ohio

[73] Assignee: The Standard Register Company, Dayton, Ohio

[21] Appl. No.: 584,973

[22] Filed: Jan. 11, 1996

Related U.S. Application Data

[63] Continuation-in-part of Ser. No. 383,836, Feb. 6, 1995, Pat. No. 5,601,313.

[51] Int. Cl.[6] ..... B42D 15/00

[52] U.S. Cl. ..... 283/81; 283/80; 283/101; 428/42.2

[58] Field of Search ..... 283/81, 80, 75, 283/101, 103, 105; 428/40.1, 42.2, 43

[56] References Cited

U.S. PATENT DOCUMENTS

| | | | |
|---|---|---|---|
| 4,128,954 | 12/1978 | White | 283/105 |
| 4,771,971 | 9/1988 | Sorensen et al. | 283/103 |
| 4,951,971 | 8/1990 | Whited | 283/105 |
| 5,139,286 | 8/1992 | Gold | 283/101 |
| 5,284,363 | 2/1994 | Gartner et al. . | |
| 5,324,078 | 6/1994 | Bane | 283/81 |
| 5,336,541 | 8/1994 | Kobayashi . | |
| 5,486,021 | 1/1996 | Laurash | 283/81 |
| 5,509,694 | 4/1996 | Laurash | 283/81 |
| 5,547,227 | 8/1996 | Laurash et al. | 283/81 |
| 5,573,277 | 11/1996 | Petkovsek | 283/103 |

*Primary Examiner*—Willmon Fridie, Jr.

*Attorney, Agent, or Firm*—Killworth, Gottman, Hagan & Schaeff, L.L.P.

[57] ABSTRACT

A multipart form and label combination is provided which may be printed on both sides with variable and nonvariable information. The combination includes a face ply and a bottom ply, each of which include a pressure sensitive adhesive and a release agent coated on respective portions of their second surfaces. The face ply and bottom ply are adhered to one another such that a portion of the adhesive-coated surface of each ply is coextensive with the release agent-coated surface of the other ply. Each ply also includes a label portion which is removable from the combination. In a preferred embodiment, the multipart form and label combination is used as a packing list incorporating shipping and return labels.

12 Claims, 7 Drawing Sheets

MULTIPART FORM AND LABEL COMBINATION

CROSS-REFERENCE TO RELATED APPLICATIONS

This application is a continuation-in-part of U.S. application Ser. No. 08/383,836 filed Feb. 6, 1995, now U.S. Pat. No. 5,601,313.

BACKGROUND OF THE INVENTION

This invention relates to a multipart form and label combination, and more particularly, to such a combination including a printable face ply adhered to a printable bottom ply, where each ply includes a label portion which may be removed from the combination.

Business forms such as invoices, labels, receipts and the like are widely used by businesses or governments to record a variety of transactions. Such forms typically contain printed nonvariable information (i.e., information which is the same on each form), as well as variable information such as names, addresses, etc., which may be printed at a later time by the user.

Frequently, several different forms are used during a transaction. For example, one business transaction may require the use of a shipping label, a packing slip, and an invoice or customer receipt. However, a disadvantage of using multiple business forms is that the forms are typically produced separately, requiring separate manufacturing and printing operations. In addition, the time and labor involved in producing and keeping inventory on multiple forms used for one transaction results in a significant cost to businesses.

Many attempts have been made to combine two or more business forms into a single form. For example, forms have been produced which include a label portion which may be removed from the remainder of the form and affixed to another surface. Such forms are typically comprised of several plies of paper, polymeric film, etc. and are coated on one or more surfaces with a pressure sensitive adhesive or release coating. However, such forms have been complex and expensive to manufacture as they require separate die cutting and printing steps.

In addition, a build-up in thickness of such forms results from the use of the label and adhesive layers, which may cause feeding and handling problems in printers. Forms with pressure sensitive adhesives also often have trouble feeding through laser printers due to the high temperatures at which the fuser rolls of the printers operate.

Accordingly, the need still exists in the art for an improved construction for a printable, multi-part form which includes separable portions, is easy to manufacture, and on which variable and nonvariable information may be easily printed.

SUMMARY OF THE INVENTION

The present invention meets those needs by providing a multipart form and label combination which may be printed on both sides with variable and nonvariable information. The combination comprises a printable face ply and a printable bottom ply which are adhered to each other, with each ply including one or more removable label portions. The multipart form and label combination of the present invention may be printed with a non-contact printer such as a laser printer, or it may be printed using a variety of other printers including mechanical impact, thermal transfer, direct thermal, and ink jet printers.

In accordance with one embodiment of the invention, a multipart form and label combination is provided comprising a printable face ply having first and second major surfaces and a printable bottom ply having first and second major surfaces.

The face ply has a pressure sensitive adhesive on at least one portion of its second surface and a release agent on at least another portion of its second surface. The bottom ply also has a pressure sensitive adhesive on one portion of its second surface and a release agent on at least another portion of its second surface. The face ply and the bottom ply are adhered together by the pressure sensitive adhesive on their respective second surfaces, with at least a portion of the adhesive-coated surface of each ply being coextensive with the release agent-coated surface on the other ply. In a preferred embodiment of the invention, the face ply is coextensive with the bottom ply.

Preferably, the face ply and bottom ply each include at least one label portion which is removable from the combination. The label portion of either ply may be removed and applied to another surface by delamination from the adhesive-coated portion of the ply in the area which is coextensive with the release agent-coated portion of the other ply. For example, the label portion of the face or bottom ply may be printed as a shipping label which is removed from the combination and adhered to a package.

In one embodiment of the invention, the face ply is adhered to the bottom ply such that the release agent on the second surface of the bottom ply contacts and is coextensive with the pressure sensitive adhesive on the second surface of the face ply, and the pressure sensitive adhesive on the second surface of the bottom ply contacts and is coextensive with the release agent on the second surface of the face ply.

The arrangement of pressure sensitive adhesive on the face ply and bottom ply may vary. For example, in one embodiment, the second surfaces of the face ply or bottom ply may include the pressure sensitive adhesive only in the label portion. In another embodiment of the invention, the second surface of the face ply or bottom ply may include the pressure sensitive adhesive in the label portion and in any portion which is not coated by the release agent. In this embodiment, the portion or portions of the face ply and bottom ply which do not include the label portion or release agent are permanently adhered to one another.

Preferably, the face ply and bottom ply each include indicia printed on their respective first surfaces. For example, the multipart form and label combination may be used as a combination packing list and shipping label, where the face ply is printed as a packing list and the label portion of the face ply is printed as a shipping label. The bottom ply may be printed with information regarding exchanges or returns, and the label portion of the bottom ply may be printed as a return label. The indicia is preferably printed with a non-contact printer such as a laser printer.

In practice, the multipart form and label combination may be preprinted with nonvariable information. Additional variable information may then be added by the end user on site by passing the face ply, bottom ply, or both, through a printer. Such variable information may include the description of items being shipped, and the name and address of the customer.

After the form and label combination has been printed with variable information, the label portion may then be removed to expose the adhesive on the second surface of the face ply, and the label affixed to a package. The remainder of the combination (packing list) may be inserted inside the package. If the package is to be returned, the bottom ply, or the back of the packing list, may be filled out and the return label portion affixed to the package.

The form and label combination of the present invention eliminates the need to use multiple forms, and allows printing of information on each side of the form in a single pass. In addition, the face ply and bottom ply are preferably adhered coextensively, so they form a flat sheet of uniform thickness which is easily passed through a laser printer.

Accordingly, it is a feature of the present invention to provide a multipart form and label combination formed of two plies adhered to each other which may be printed on both sides with information and which includes at least one removable label portion on each ply. These, and other features and advantages of the present invention will become apparent from the following detailed description, the accompanying drawings, and the appended claims.

DETAILED DESCRIPTION OF THE PREFERRED EMBODIMENTS

Figure 1A:
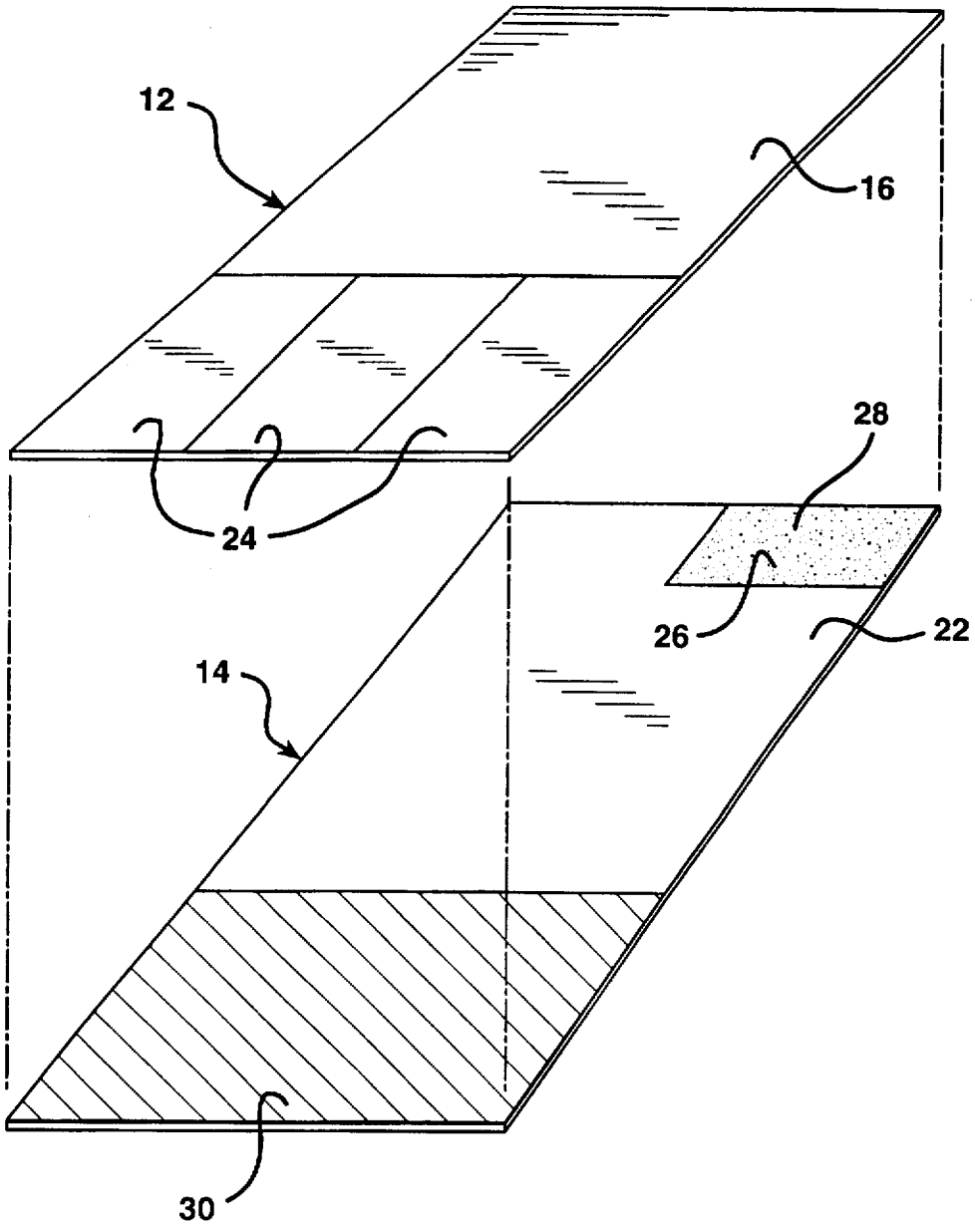
FIG. 1A is an exploded top view of the multipart form and label combination of the present invention.
Figure 1B:
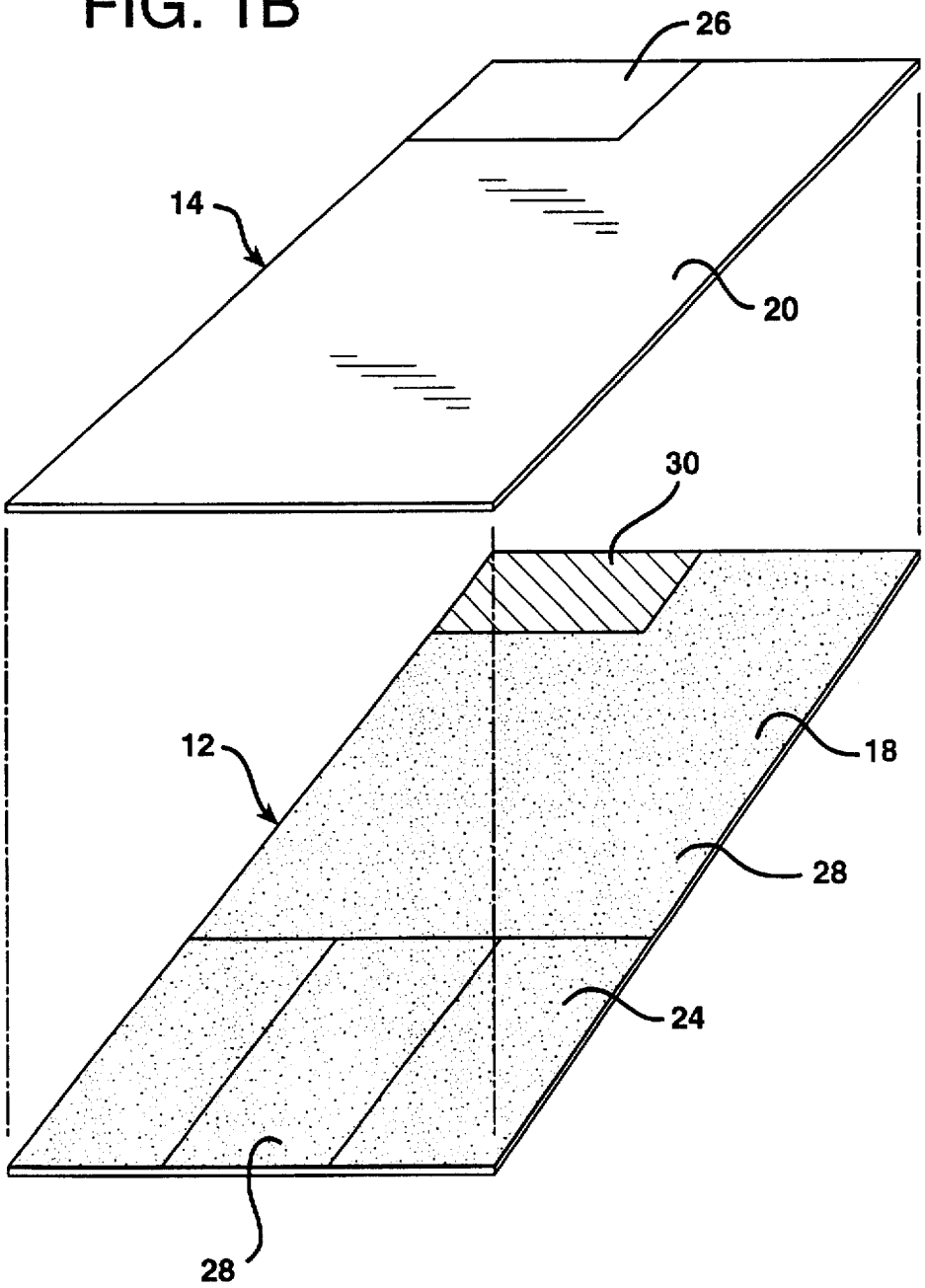
FIG. 1B is an exploded bottom view of the combination of FIG. 1A.
Figure 2:
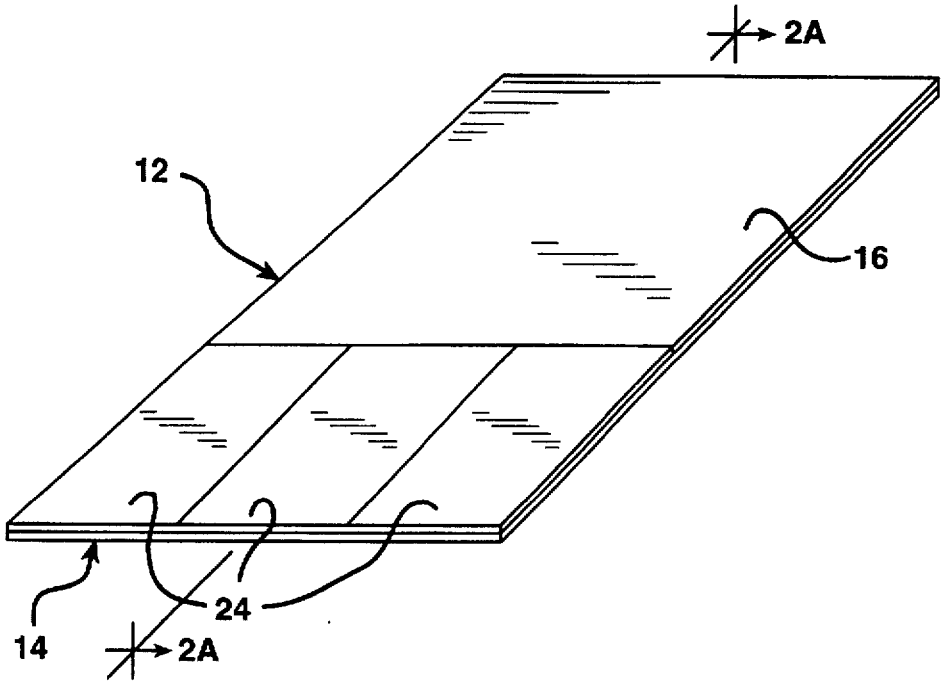
FIG. 2 is a perspective view of the form and label combination of FIG. 1A.
Figure 3A:
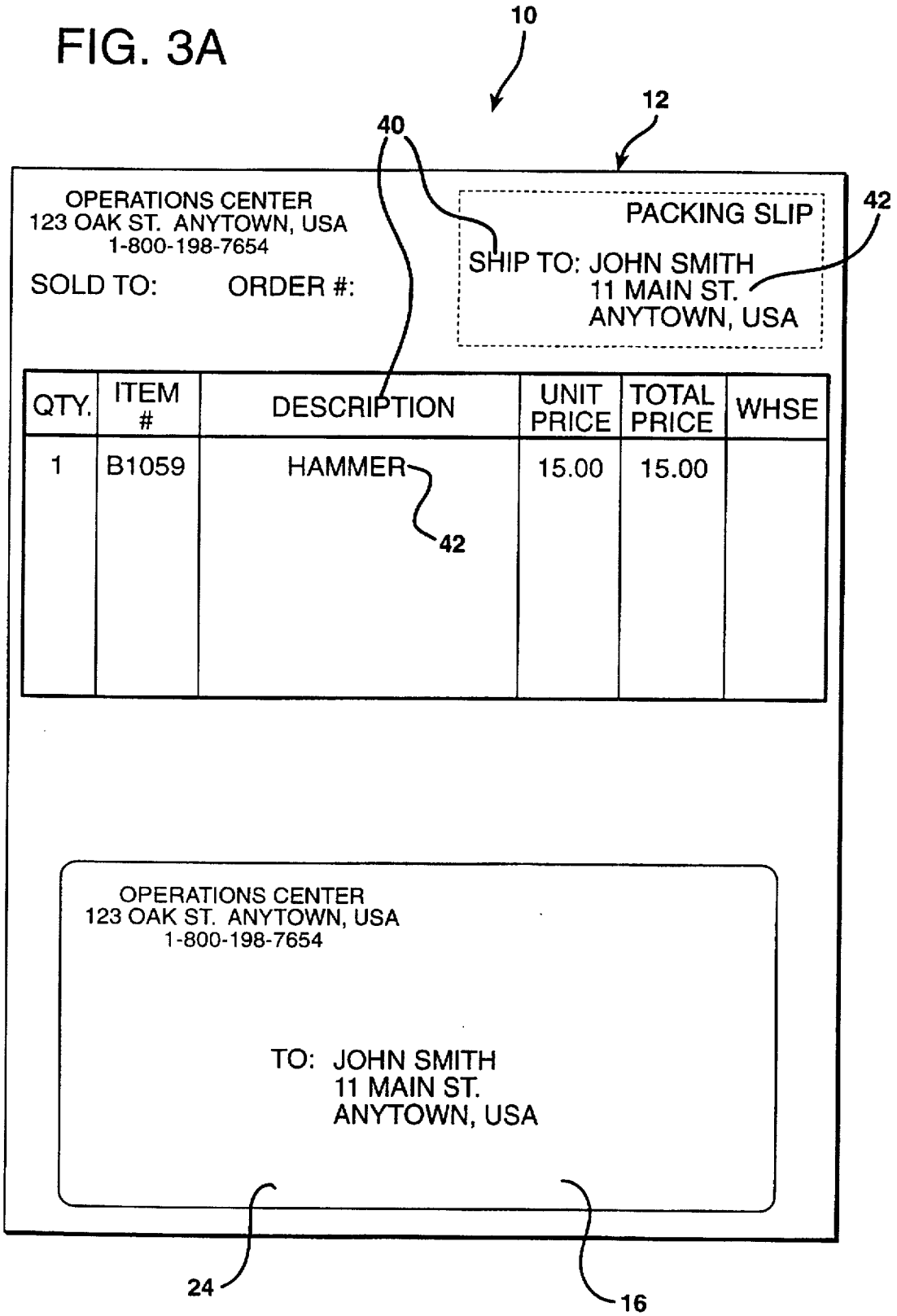
FIG. 3A is a top plan view of the multipart form and label combination including nonvariable and variable indicia.

Referring, collectively, to FIGS. 1A, 1B and FIG. 2, one embodiment of the multipart form and label combination 10 is shown which comprises a printable face ply 12 and a bottom ply 14. The face ply 12 includes first surface 16 and second surface 18. The face ply is preferably comprised of toner or ink receptive paper, and the first surface 16 of the face ply may be printed with both nonvariable indicia and variable indicia as shown in FIG. 3A. By nonvariable indicia, we mean repetitive information which is the same from form to form, while variable indicia refers to information which varies from form to form, such as names, addresses, and the like. The former is preferably printed when the form is manufactured, while the latter variable indicia are printed by the shipper.

Figure 3B:
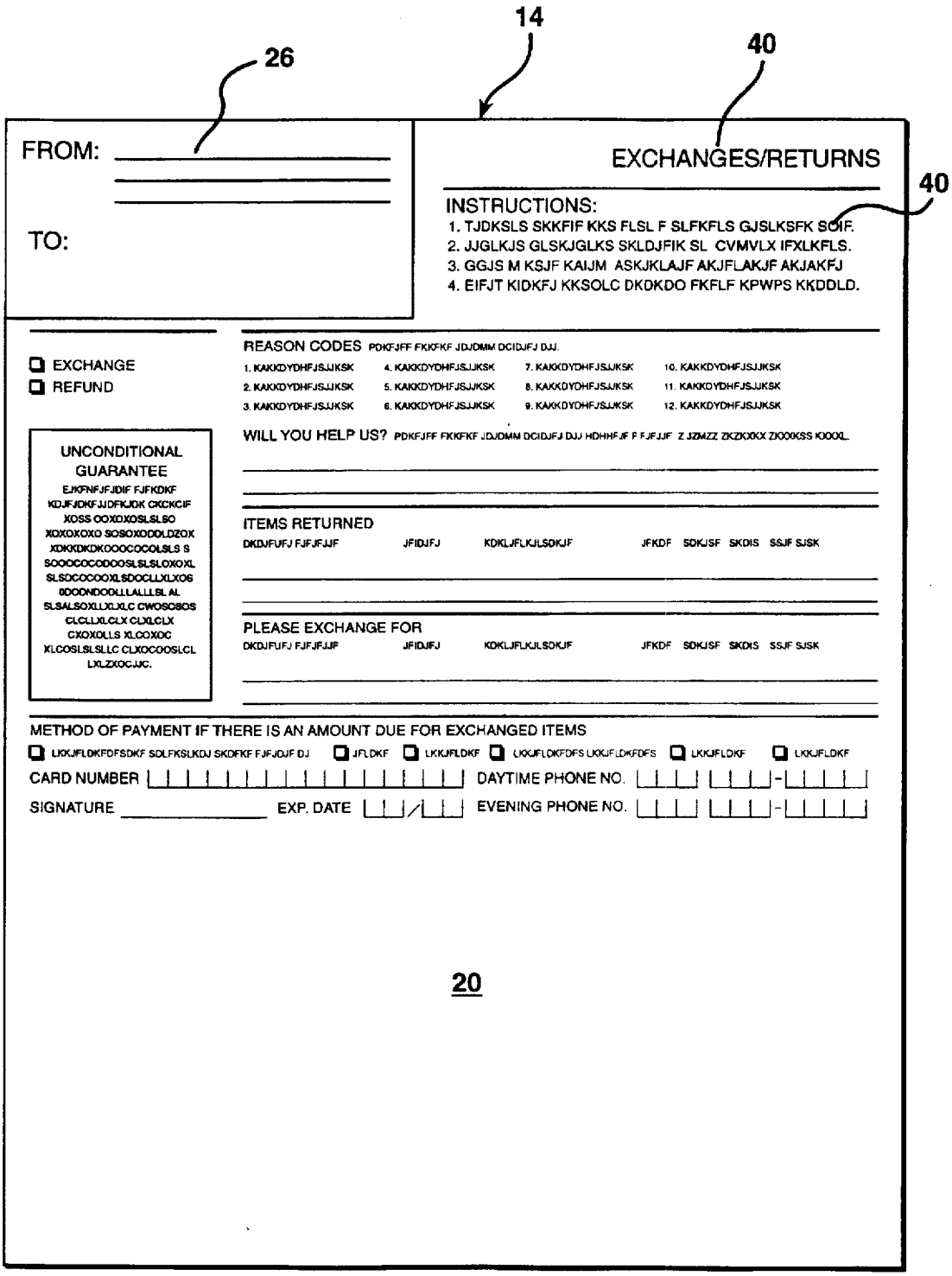
FIG. 3B is a bottom plan view of the multipart form and label combination including nonvariable and variable indicia.

The bottom ply 14 comprises first surface 20 and second surface 22, and is also preferably comprised of an ink or toner receptive paper. As shown in FIG. 3B, the first surface of the bottom ply also preferably is printed with nonvariable indicia.

The face ply and bottom ply of the combination also each include at least one label portion 24, 26 which is removable from the combination. The labels are preferably die cut into each ply. As shown in FIGS. 1A and 1B, the face ply 12 includes three removable labels 24, and the bottom ply includes one removable label 26. However, it should be appreciated that each ply may have one or more labels, and the labels may vary in size and shape. Any arrangement of labels on the plies is suitable as long as the label portion includes a pressure sensitive adhesive on its second surface which contacts a release coating on the other ply so that the label is readily peelable from the combination.

In the embodiment shown in FIG. 1B, the label portion 24 of the face ply 12 has a pressure sensitive adhesive 28 on its second surface 18. As shown in FIG. 1A, the portion of the bottom ply 14 which is in contact with the label portion 24 of the face ply includes a release agent 30 on a portion of its second surface 22 such that the labels on the face ply may be readily peeled away from the bottom ply.

The label portion 26 of bottom ply 14 also includes a pressure sensitive adhesive 28 on its second surface 22 as shown in FIG. 1A. As shown in FIG. 1B, the portion of the face ply 12 which is in contact with the label 26 includes a release agent 30 on its second surface 18.

Figure 1C:
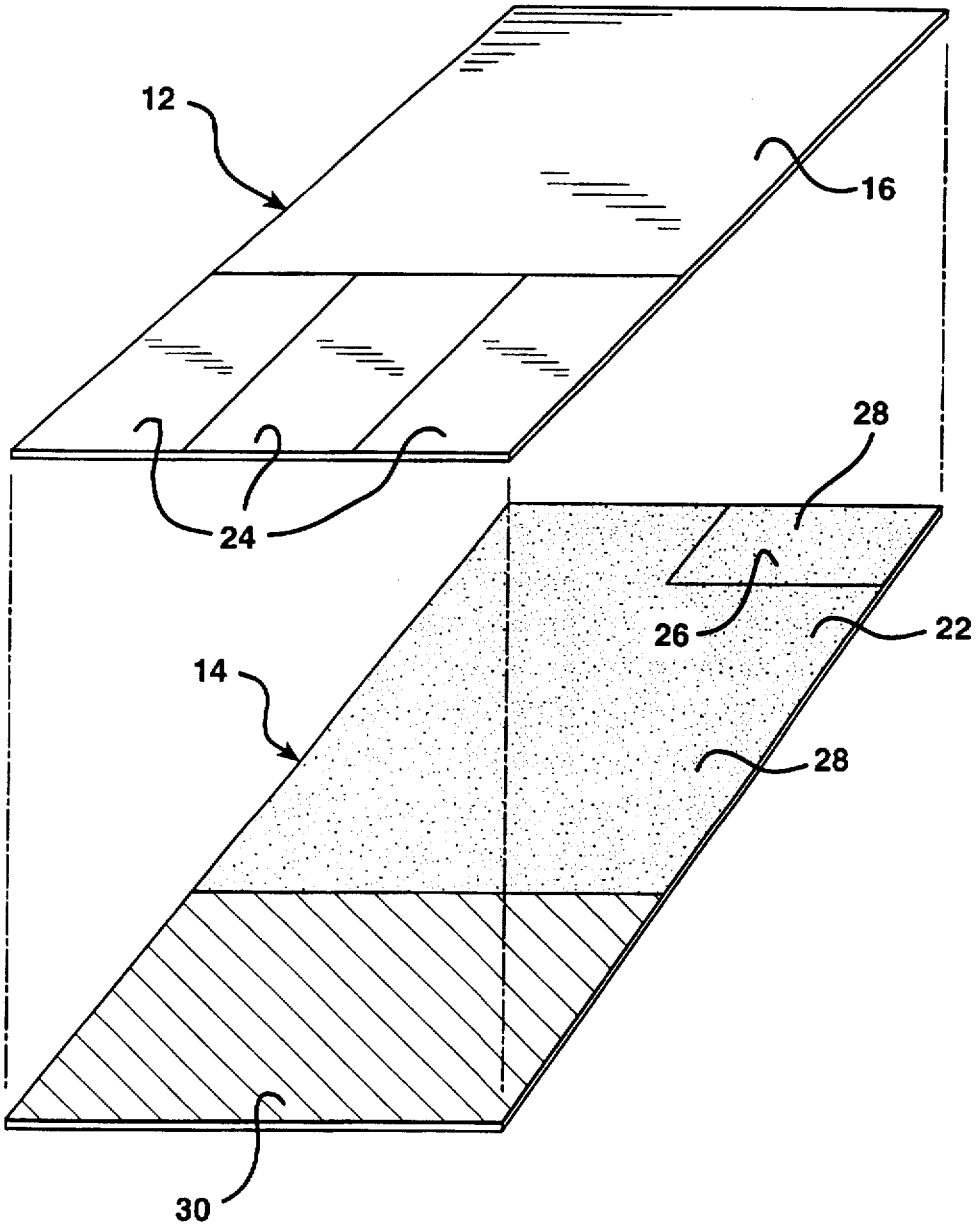
FIG. 1C is an alternative embodiment of the form and label combination shown in FIG. 1A.
Figure 2A:
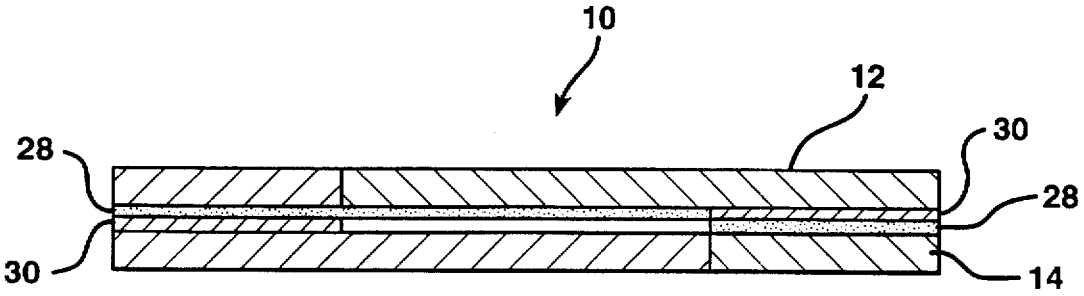
FIG. 2A is a side view taken along line 2A—2A of FIG. 2.
Figure 2B:
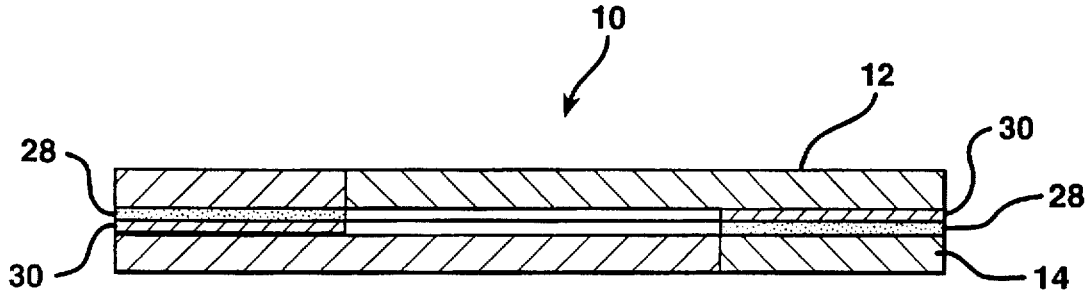
FIG. 2B is a side view of the form and label combination illustrating another embodiment of the invention.
Figure 2C:
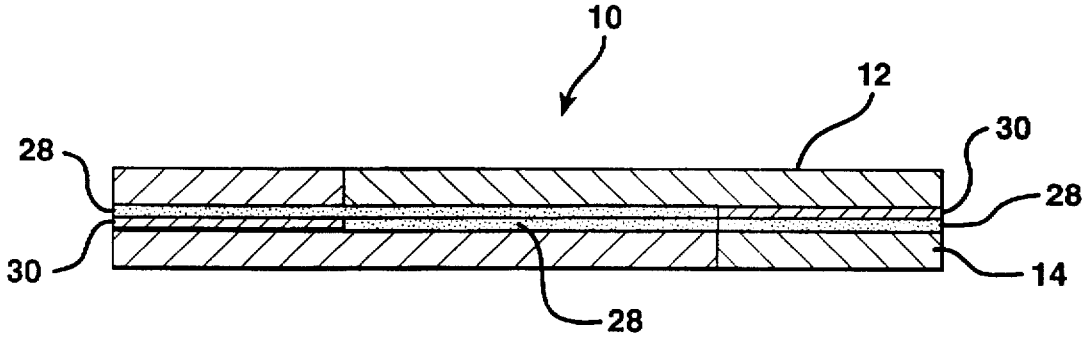
FIG. 2C is a side view of the form and label combination illustrating another embodiment of the invention.

The remaining portions of the face ply and bottom ply which do not include a label portion or release agent may be left uncoated as shown in FIG. 2B, or may include a pressure sensitive adhesive on one or both plies so that the remaining portions remain permanently adhered to one another. FIGS. 1A, 1B, and 2A show one possible arrangement in which the remaining portion of the second surface 18 of the face ply 12 is coated with a pressure sensitive adhesive 28 and the remaining portion of the second surface 22 of the bottom ply 14 is left uncoated. FIGS. 1B, 1C and 2C illustrate another possible arrangement in which the remaining portions of the face ply and bottom ply which do not include a label portion or release agent include a pressure sensitive adhesives Alternatively, the remaining portions of one or both plies may be pattern coated with pressure sensitive adhesive.

If desired, the second surfaces of one or both plies may include carbonless coatings. Such coatings typically comprise initially colorless color formers and color developers which combine to form a visible image upon the application of pressure. The carbonless coatings may be used to provide a duplicate image on the second surfaces of either the face ply or bottom ply when the first surface of the face ply or bottom ply is imaged with an impact printer or with a writing implement. If desired, a self-contained carbonless coating may be utilized in which either the color formers or color developers are encapsulated. For example, one or both plies may be fully coated with the self-contained coating prior to the application of the release agent such that a duplicate image appears on any portion of the form, including the area(s) containing the release agent. In this instance, the release agent should preferably be transparent.

FIGS. 3A and 3B illustrate a preferred embodiment in which the multipart form and label combination comprise a packing list incorporating shipping and return labels. As shown, the first surface 16 of face ply 12 includes nonvariable indicia 40 which is preprinted on the form as well as variable indicia 42 which may include a customer address or a description of items being shipped as shown. In the embodiment shown, the form includes a single shipping label 24 which is printed with the customer address. When a package is ready to be shipped, the shipping label may be removed and adhered to the package, with the remainder of the form being placed inside the package.

As shown in FIG. 3B, the first surface 20 of the bottom ply 14 is also printed with nonvariable indicia 40. This side of the form is designed to be used for exchanges or returns. In the event that merchandise is to be returned, information can be added by the customer with a printer or by writing the appropriate information by hand. The label portion 26 can then be removed and adhered to the package for return shipment.

While the form and label combination has been illustrated as a combined packing list and shipping label, it should be appreciated that the combination of the present invention may also be used for any number of applications in which it is desirable to combine a business form with a removable label.

The multipart form and label combination of the present invention may be produced as a continuous web product or as a cut sheet product. Preferably, the face ply and bottom ply are separately spot coated on their second surfaces with a release agent such as a silicone polymer. Next, the first surfaces of each ply are printed with nonvariable indicia. If desired, the first surfaces of each ply may then be coated with a toner receptive coating such as that described in commonly assigned U.S. Pat. No. 5,045,426 to Maierson et al entitled "Toner Adhesion-Enhancing Coating for Security Documents", the disclosure of which is hereby incorporated by reference.

After preprinted nonvariable information is added to each ply, a pressure sensitive adhesive is then coated on the second surface of each ply in the desired portions, and the two plies are then joined together with their second surfaces adhered to each other. The single form is then advanced through a die cutting station. The forms are then ready for shipment to a customer where variable information may be added by the end user.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A multipart form and label combination comprising:

a printable face ply having first and second major surfaces, said face ply having a pressure sensitive adhesive on at least one portion of said second surface and a release agent on at least another portion of said second surface;

a printable bottom ply having first and second major surfaces, said bottom ply having a pressure sensitive adhesive on at least one portion of said second surface and a release agent on at least another portion of said second surface; wherein said second surface of said face ply and said second surface of said bottom ply are adhered together by said pressure sensitive adhesive on their respective second surfaces, with at least a portion of the adhesive-coated surface of each ply being coextensive with the release agent-coated surface on the other ply, and wherein said face ply and said bottom ply each include at least one label portion which is removable from said combination with said pressure sensitive adhesive on its second surface by removing it from the adhesive-coated portion of the ply in the area which is coextensive with the release agent coated portion of the other ply.

2. The combination as claimed in claim 1 in which said face ply is coextensive with said bottom ply.

3. The combination as claimed in claim 1 in which said second surface of said face ply includes said pressure sensitive adhesive only on said portion of said face ply including said label portion.

4. The combination as claimed in claim 1 in which said second surface of said bottom ply includes said pressure sensitive adhesive only on said portion of said bottom ply including said label portion.

5. The combination as claimed in claim 1 in which said second surface of said face ply includes said pressure sensitive adhesive in said label portion and in the portion which is not coated by said release agent.

6. The combination as claimed in claim 1 in which said second surface of said bottom ply includes said pressure sensitive adhesive in said label portion and in the portion which is not coated with said release agent.

7. The combination as claimed in claim 1 in which said face ply is adhered to said bottom ply such that said release agent on said second surface of said bottom ply contacts and is coextensive with said pressure sensitive adhesive on said second surface of said face ply, and said pressure sensitive adhesive on said second surface of said bottom ply contacts and is coextensive with said release agent on said second surface of said face ply.

8. The combination as claimed in claim 1 in which said face ply and said bottom ply include indicia printed on their respective first surfaces.

9. The combination as claimed in claim 8 in which said indicia has been printed with a non-contact printer.

10. The combination as claimed in claim 8 in which said label portion is printed as a shipping label.

11. The combination as claimed in claim 8 in which said label portion is printed as a return label.

12. The combination as claimed in claim 1 in which the portions of said face ply and bottom ply which do not include a label portion are permanently adhered together.

* * * * *